US008286413B2

(12) United States Patent
Atkinson et al.

(10) Patent No.: US 8,286,413 B2
(45) Date of Patent: Oct. 16, 2012

(54) NANOFIBRE YARNS

(75) Inventors: Kenneth Ross Atkinson, Highton (AU); Niall Finn, Lethbridge (AU)

(73) Assignee: Commonwealth Scientific and Industrial Research Organisation (AU)

( * ) Notice: Subject to any disclaimer, the term of this patent is extended or adjusted under 35 U.S.C. 154(b) by 347 days.

(21) Appl. No.: 12/525,795

(22) PCT Filed: Feb. 5, 2008

(86) PCT No.: PCT/AU2008/000135

§ 371 (c)(1),
(2), (4) Date: Feb. 2, 2010

(87) PCT Pub. No.: WO2008/095239

PCT Pub. Date: Aug. 14, 2008

(65) Prior Publication Data

US 2010/0126134 A1 May 27, 2010

(30) Foreign Application Priority Data

Feb. 5, 2007 (AU) ..... 2007900533

(51) Int. Cl.
*D02G 3/02* (2006.01)

(52) U.S. Cl. ..... 57/210

(58) Field of Classification Search ..... 57/1 R, 57/3, 6, 13, 200, 210, 230; 977/742, 842, 977/961

See application file for complete search history.

(56) References Cited

U.S. PATENT DOCUMENTS

| | | | | |
|---|---|---|---|---|
| 4,028,871 | A * | 6/1977 | Aschenbrenner | 57/402 |
| 4,362,008 | A * | 12/1982 | Parker et al. | 57/5 |
| 5,927,060 | A * | 7/1999 | Watson | 57/210 |
| 6,106,913 | A * | 8/2000 | Scardino et al. | 428/36.3 |
| 6,230,524 | B1 * | 5/2001 | Kolmes et al. | 66/172 R |
| 6,308,509 | B1 * | 10/2001 | Scardino et al. | 57/402 |
| 6,779,330 | B1 * | 8/2004 | Andrews et al. | 57/210 |
| 2004/0053780 | A1 | 3/2004 | Jiang et al. | |
| 2005/0170177 | A1 * | 8/2005 | Crawford et al. | 428/375 |
| 2007/0166223 | A1 | 7/2007 | Jiang et al. | |
| 2008/0170982 | A1 * | 7/2008 | Zhang et al. | 423/447.3 |
| 2009/0282802 | A1 * | 11/2009 | Cooper et al. | 57/238 |

FOREIGN PATENT DOCUMENTS

| | | |
|---|---|---|
| CN | 1537981 A | 10/2004 |
| CN | 200610023797 | 10/2006 |
| CN | 101003916 A | 7/2007 |
| CN | 101033563 A | 9/2007 |

(Continued)

OTHER PUBLICATIONS

International Search Report and Written Opinion for PCT Application No. PCT/AU2008/000135, 7 pages, Mar. 17, 2008.

(Continued)

*Primary Examiner* — Shaun R Hurley

(74) *Attorney, Agent, or Firm* — Brinks Hofer Gilson & Lione

(57) ABSTRACT

A nanofiber yarn assembly including a longitudinally extending core for the yarn assembly and, twisted about the core, at least one ribbon of multiple nanofibers. The yarn assembly can be formed by drawing a longitudinally extending core for the yarn assembly through a concentric core-spinning zone, and, as the core travels through the core-spinning zone, twisting at least one ribbon of multiple nanofibers about the travelling core. Apparatus is also disclosed.

34 Claims, 6 Drawing Sheets

FOREIGN PATENT DOCUMENTS

WO WO 2007/015710 A2 2/2007

OTHER PUBLICATIONS

Mei Zhang, Shaoli Fang, Anvar A. Zakhidov, Sergey B. Lee, Ali E. Aliev, Christopher D. Williams, Ken R. Atkinson, and Ray H. Baughman, *Strong, Transparent, Multifunctional, Carbon Nanotube Sheets*, Science (Aug. 19, 2005) 309: 1215-1219.

Ray H. Baughman, Anvar A. Zakhidov, and Walt A. de Heer, *Carbon Nanotubes—the Route Toward Applications*, Science (Aug. 2, 2002) 297: 787-792.

W.E. Teo and S. Ramakrishna, *A review on electrospinning design and nanofibre assemblies*, Nanotechnology 17 No. 14 (Jul. 28, 2006) R89-R106.

* cited by examiner

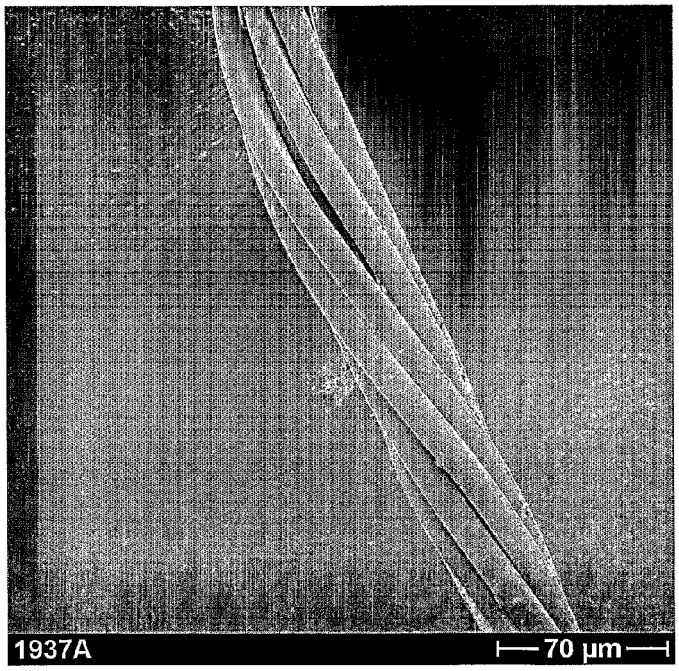
Figure 5: Parent multi-filament polyamide yarn used as a core for core-spinning CNT ribbons.
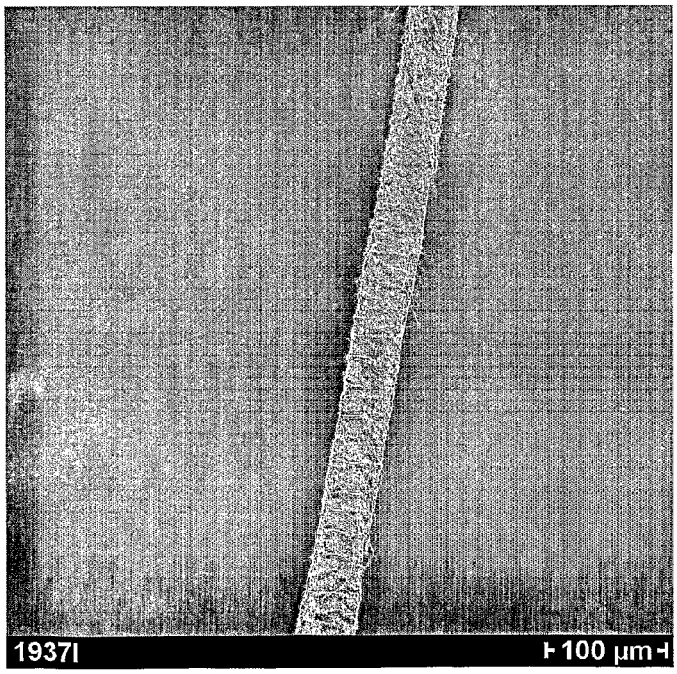
Figure 6: SEM showing a CNT nanofibre ribbon core-spun around a nylon multi-filament core at an angle of wrap of about 40°.

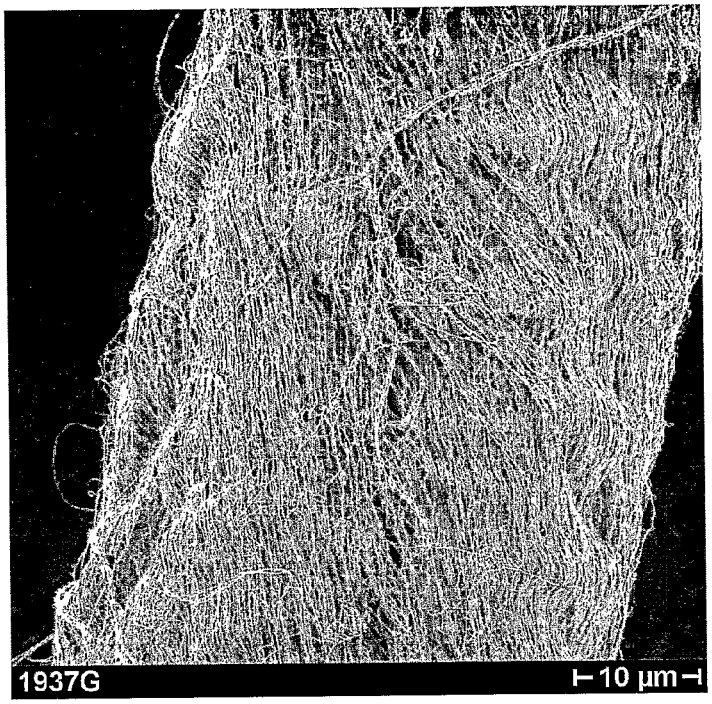
Figure 7: Higher magnification SEM showing the fibrillar structure of the CNT ribbon core spun around a polyamide multifilament core yarn.

NANOFIBRE YARNS

This application is a filing under 35 U.S.C. §371 of International Patent Application PCT/AU2008/000135, filed Feb. 5, 2008, which claims priority to Australian application no. AU 2007900533, filed Feb. 5, 2007.

FIELD OF THE INVENTION

This invention relates generally to the formation of nanofibres into yarns having a combination of useful properties such as high strength or high electrical conductivity. The invention has particular application to the formation of useful assemblies of carbon nanofibres.

BACKGROUND OF THE INVENTION

Any reference in this specification to prior art disclosures is not to be construed as an admission that the respective disclosures are common general knowledge, in Australia or elsewhere.

Nanofibres can be made in a number of forms from various materials. Carbon nanotubes (CNTs) are one example and they occur as either a single walled tube (SWNT) or a multi-walled tube (MWNT). The structure of SWNTs is that of a one-dimensional graphene sheet that is coiled about an axis to form the nanotube. MWNTs consist of a number of SWNTs all formed around a common axis. The diameters of SWNTs are typically less than ~1 nm, whereas the diameters of MWNTs may comprise many tens of tubes with final diameters of the order of 50 nm or more. Lengths are commonly in the order of tens of microns for SWNTs, up to several millimeters for MWNTs.

Carbon nanotubes, particularly of the single-walled variety, have a range of spectacular properties that are of great technological interest: including high elastic modulus (~1 TPa) and high mechanical strength (~30 GPa) (R. H. Baughman, A. A. Zakhidov, and W. A. de Heer, Science, 297, 787-792, 2002). A low volumetric density (~1330 kg/m$^3$) means that the specific properties are even more exceptional when compared with most other materials, e.g., the modulus and strength of SWNTs are ~20 and ~50 times that of high tensile steel. SWNTs also display excellent transport properties such as high electrical conductivity (10-30 kS/cm) and high thermal conductivity (~2000 W m$^{-1}$ K$^{-1}$).

A significant problem for the practical application of CNTs has been the absence of a method to assemble the trillions of nanotubes into macro-sized items, such as fibres or objects. One approach has been to use fluids such as surfactants or polymers to assemble the CNTs into macro-structures, but there are several problems associated with 'wet' processing of this kind. Firstly, dispersing CNTs into the fluids causes significant breakage of the CNTs, inhibiting the properties of the composites. Another problem is that the viscosity of the fluid increases rapidly with the concentration of the CNTs, which limits ultimate concentrations to less than 10%. Finally, if the CNTs are filtered from the dispersion to produce a CNT paper, it is found that residual traces of the fluids remain on the nanotubes that significantly reduce transport of electrons or phonons.

In a surprising development, it was shown (M. Zhang, S. Fang, A. Zakhidov, S. B. Lee, A. Aliev, C. Williams, K. Atkinson, R. H. Baughman, Science, 309, 1215 (2005) and International patent application PCT/US2005/41031) that twist could be used to spin CNTs into a yarn in much the same way as for conventional fibres. This successfully overcame the problems of wet processing, being based on solid-state processing of nanotubes. The construction of these yarns required much higher twists compared with conventional yarns because of their much smaller diameters. The authors of the cited paper reported that yarns with diameters of about 1 μm had quite good tenacity and high electrical conductivity for twists of about 50 000 m$^{-1}$. Given the fineness of the nanotube yarn, ~1 μm, which is 100 times smaller than the equivalent worsted yarn, the high levels of twist ensure the same helix angle of the nanotubes that in turn ensure reasonable tensile properties. This method utilises MWNTs grown in forests with the important property that once the nanotubes on an outer face of the forest are withdrawn, the nanotubes in the next row are pulled with it. This process continues indefinitely through the ranks of nanotubes in the forest, ultimately creating a continuous web of nanotubes that has sufficient integrity to be used by itself or twisted into a yarn. The webs and yarns have excellent mechanical strength and electrical conductivity and can be used in many applications.

The spinning mechanism itself was found to be similar to conventional spinning of staple fibres. Conventional staple fibres such as wool and cotton are of finite length but are assembled into continuous yarns by the use of twist. The structural mechanics of such yarns is complicated, but study shows that fibre structures generated during spinning are able to convert some of the tensile load into a normal force between the fibres that in turn generates the frictional force that holds the yarn together. As twist is inserted into the fibre assembly, the position of the fibres 'migrates' from the surface of the yarn to the centre and back to the surface to create a coherent entangled structure. All sufficiently long fibres migrate in this way and the fibre structure created converts some of the applied tensile load into a normal force between the fibres and therefore a frictional force that is able to oppose the tension.

A difficulty facing this method for producing fibre is the prodigious levels of twist required and the consequent low production speed. It is well known in the textile industry that production speed is proportional to the spinning speed and for a conventional worsted yarn with a fibre of 20 μm diameter and a mean length of about 70 mm, the threadline speed is about 20 m/min for a spinning speed of 12 000 min$^{-1}$ and a twist of 600 m$^{-1}$. Clearly, if the required twist for a CNT yarn is as high as 60 000 m$^{-1}$, then the yarn speed will decrease to only 200 mm/min if the spinning speed remains at 12 000 min$^{-1}$. The only way to increase threadline speed for pure CNT yarns is to increase the spinning speed.

It is an object of the invention to at least in part alleviate these problems, that is to counter the slow production rates of nanofibre yarns such as carbon nanotube yarns while retaining the benefits of the structure of the yarns that follow from the solid-state method of assembly.

SUMMARY OF THE INVENTION

The present invention essentially entails the concept of forming nanofibre yarns as core-spun nanofibre yarns, in which a nanofibre ribbon is spun around a core of a suitable material. This core-spinning concept can be applied to produce novel structures for use in a variety of applications.

The invention, in a first aspect, provides a nanofibre yarn assembly including a longitudinally extending core for the yarn assembly and, twisted about the core, at least one ribbon of multiple nanofibres.

In a second aspect, the invention provides a method of forming a nanofibre yarn assembly, comprising drawing a longitudinally extending core for the yarn assembly through a concentric core-spinning zone, and, as the core travels through the core-spinning zone, twisting at least one ribbon of multiple nanofibres about the travelling core.

The invention further provides, in a third aspect, apparatus for forming a nanofibre yarn assembly, comprising means to draw a longitudinally extending core for the yarn assembly through a concentric core-spinning zone, support structure to mount a source of nanofibres in or adjacent to the concentric core-spinning zone, and means to twist at least one ribbon of multiple nanofibres drawn from said source about the core, as the core travels through the concentric core-spinning zone.

In an important application of the invention, the nanofibres are carbon nanotubes (CNTs). Conveniently, the source of the carbon nanotubes twisted as a ribbon about the core is one or more nanotube forests supported on a respective substrate, on which the nanotubes may typically have been grown.

Preferably, the or each nanotube ribbon is formed by drawing the nanotubes laterally of the nanotube orientation as a continuous assembly of linked nanotubes.

In one embodiment, one or more, preferably a plurality of, ribbons of CNTs are drawn from respective forests by a core, itself comprising a yarn or filament, as it is unwound from a supply package or bobbin and wound onto a take-up package, and, as the ribbons are so drawn, the CNT forests are rotated around the threadline so as to cause the ribbons to be twisted around the core at defined helix angles. The helix angle is set by the ratio of the threadline speed to the rotational speed of the forest support structure. The helix angles may be as low as about 10°, which is similar to angles of twist used for conventional textile yarns, or much higher, with angles of about 45° or more depending on technical requirements.

In other embodiments, several separate forests can be used at a single station or it is possible to use a number of stations. When several stations are used, plural layers of nanofibre ribbons may be spun onto a core in order to create and enhance the properties of the core-spun yarn. In this case, an option is to core-spin the ribbons of nanofibres in opposite directions around the core.

Alternatively, the support structure for the nanofibre source is fixed, whereby the substrate supporting the or each forest is fixed and the yarn assembly is rotated as it is pulled past the forest(s) so that the nanotube ribbon is twisted on at the desired helix angle. Rotation of the yarn assembly is achieved by spinning the take-up or supply package or both.

The core may be a conventional textile material such as cotton, wool, polyester, polyamide and other commonly available polymers. The core may be a mono- or multi-filament. Other suitable materials include nylon, polyester, polyethylene, polystyrene, carbon fibre, high strength polymeric filament such as Kevlar®, Dyneema®, Twaron® or Spectra®, glass or optical fibre, conventional textile yarn, or metal wire such as aluminium, or any combination of core materials. The core may itself have a plurality of such components and may include braided or knitted structures. The core is preferably a structure not itself containing nanofibres but in particular embodiments may include or comprise nanofibres.

In some embodiments, nanotube core-spun yarns according to the present invention provide unique properties and property combinations such as enhanced toughness, high electrical and thermal conductivities, high field emission, and high surface area for absorption of active agents. Nanotube core-spun yarns can thereby serve as conducting textiles. Furthermore, these nanotube core-spun yarns can be spun with either fine or coarse wires to enhance the field emission of electrons.

The nanofibre core-spun yarns of the present invention can be used in a variety of diverse applications and include textiles; electronic devices; conducting wires and cables; electrochemical devices such as fibre-based supercapacitors, batteries, fuel cells, artificial muscles, and electrochromic articles; field emission and incandescent light emission devices; protective clothing; tissue scaffold applications; and mechanical and chemical sensors.

BRIEF DESCRIPTION OF THE DRAWINGS

FIG. 5 shows a SE micrograph of an example of a multi-filament polyamide yarn used as a core for core-spinning CNT ribbons.

FIG. 6 shows a SE micrograph of an embodiment of the invention comprising a CNT nanofibre ribbon core-spun around a nylon multi-filament core at an angle of twist of about 40°; and FIG. 7 shows a higher magnification SE micrograph of the fibrillar structure of a CNT ribbon core-spun around a polyamide multifilament core yarn.

DETAILED DESCRIPTION OF EMBODIMENTS OF THE INVENTION

Preferred nanofibre sources for producing core-spun yarns according to the invention with the illustrated apparatus configurations are nanofibre forests with the special property of drawability, by which is meant the tendency of the nanofibres to form continuous strands or ribbon-like assemblies. When a forest is produced with this property, if nanofibres at the edge of the forest are pulled away laterally of the orientation of the nanofibres, i.e. generally parallel to the plane of the substrate supporting the forest, they 'recruit' the next layer of nanotubes and so on. If this process continues indefinitely, a ribbon is formed comprising a continuous assembly of linked nanotubes that has some unusual and useful properties, which include electrical and thermal conductivity, and high specific tensile strength. Moreover, because the ribbon is only about 20 μm thick in its undensified form, it is transparent. The process is disclosed and illustrated in the abovementioned international patent application.

Special conditions are required to grow forests with the property of drawability and the standard method of production for carbon nanotubes provides the nanotube forests on silicon wafers. In preferred embodiments of the invention, these wafers are mounted on special purpose core-spinning apparatus. The dimensions of the wafers for core-spun spinning may be any size and shape, but rectangular wafers are preferred with widths of 10 mm and of lengths to suit production. Preferred lengths of the wafers are between 20 mm to 100 mm although it is obvious to those skilled in the art that other dimensions could be used.

Figure 1:
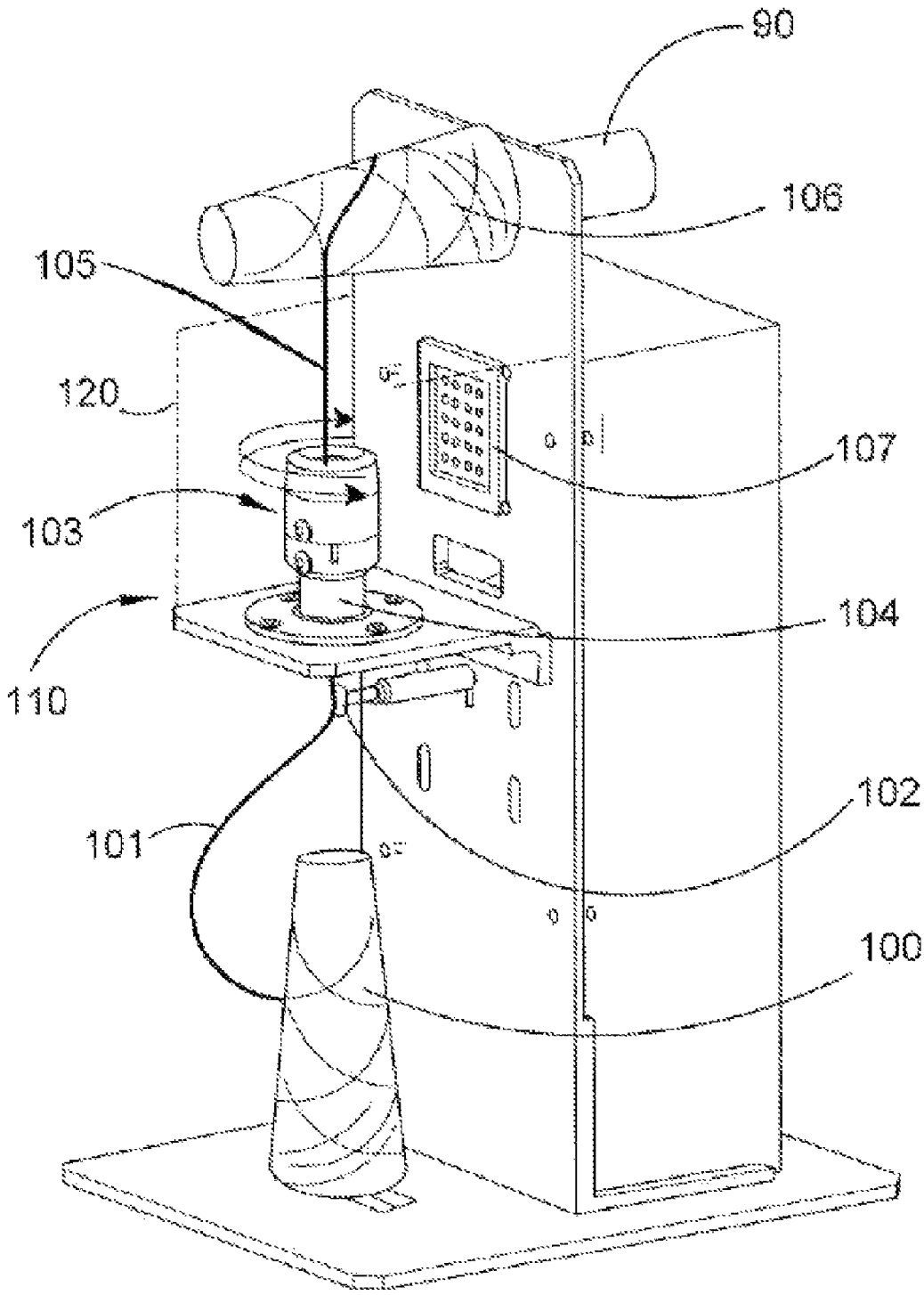
FIG. 1 is a schematic drawing of a CNT core-spun spinner according to an embodiment of the invention and shows a reserve spool of supply filament, yarn, or wire underneath a rotating head (driving belt or motor not shown) that supports several wafers on which drawable CNT forest has been grown. The yarn from the supply spool is drawn through the rotating head by the take-up package and is wound on in the usual way.

A preferred design of a single-stage core-spinner is shown in FIG. 1, which shows a rotatably supported supply package 100 containing a selected filament, yarn, braid, or wire 101, to form the core of the yarn assembly, and a spindle 90 for a take-up package 106. Spindle 90 is rotatable to draw core 101 through a hollow spindle 103 of a core-spinning head 110 and to wind it onto take-up package 106. A thread guide 102 controls the location of the core and the assembly in the core-spinning spindle. The spindle 103 defines a concentric core-spinning zone and can rotate in either direction depending on the direction that the spindle whorl 104 is driven by a belt from a motor (not shown). The speed of the core-spinning spindle is set by the desired helix angle of the nanofibre web onto the core yarn to form the core-spun yarn 105. The core-spinning spindle 103 is enclosed in a substantially airtight container (broken line 120) and the air is evacuated through vent 107. A filter, not shown, placed over the vent is used to collect any nanofibres that might be released during spinning.

Figure 2:
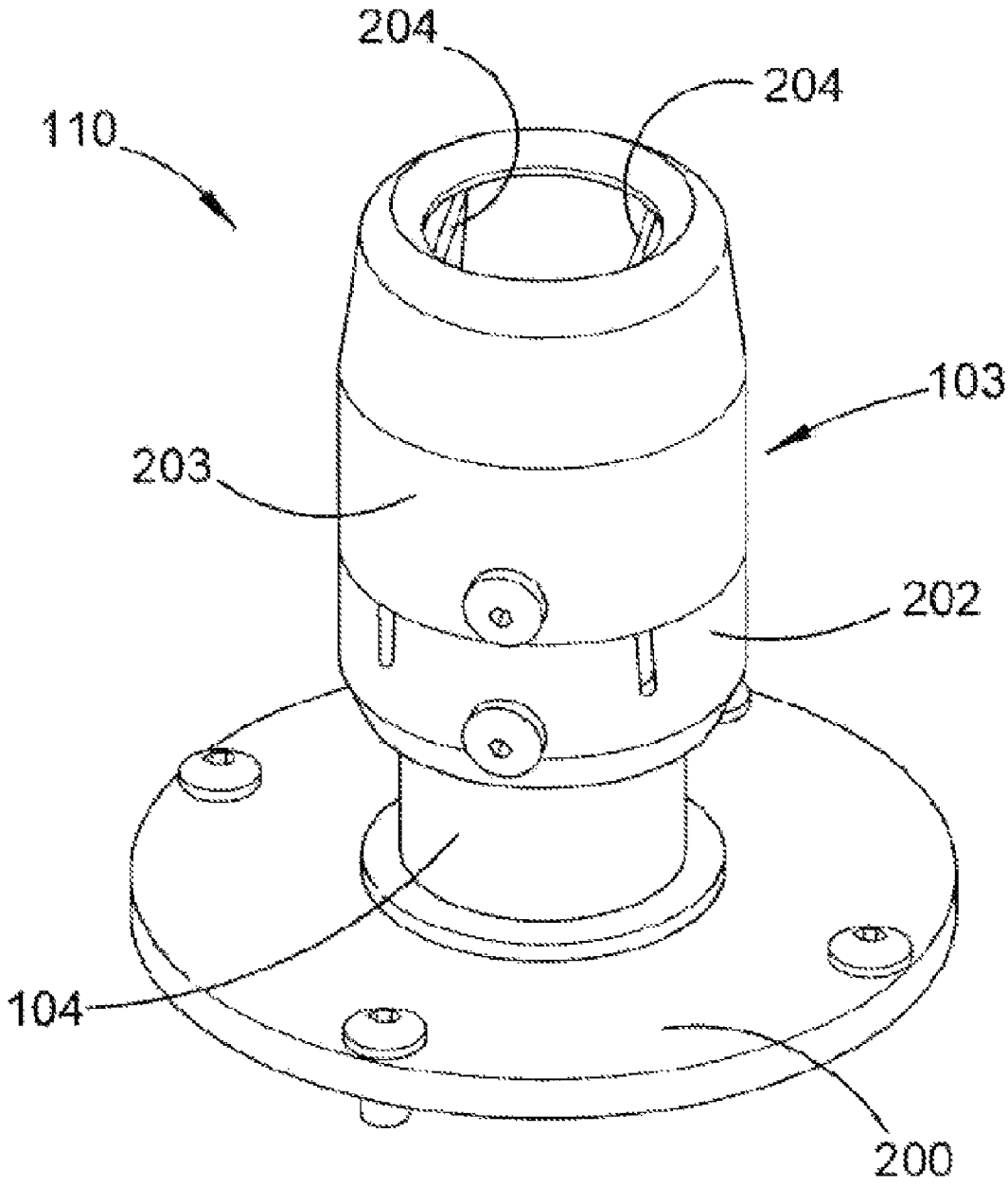
FIG. 2 gives a detailed view of an exemplary core-spun spinning head used to core-spun nanofibre web onto cores of various materials and structures.

A close-up of the core-spinning head 110 is shown in FIG. 2 in which base 200 of the core-spinning head is used to attach the unit to a larger frame as one element of a multi-head spinner. The spindle whorl 104 is driven by a belt (not shown), driven by a motor. The belt and motor may typically drive a number of core-spinning heads comprising a multihead machine. Support body 202 for CNT forest wafers is integrated onto the spindle 103 as a co-axial generally cylindrical extension, and, is surrounded by the hollow, slightly conical wafer enclosure 203 to prevent the wafers flying off if they detach during high-speed operation. The tops of two wafers 204 are visible at the top of the core-spinning head.

Figure 3:
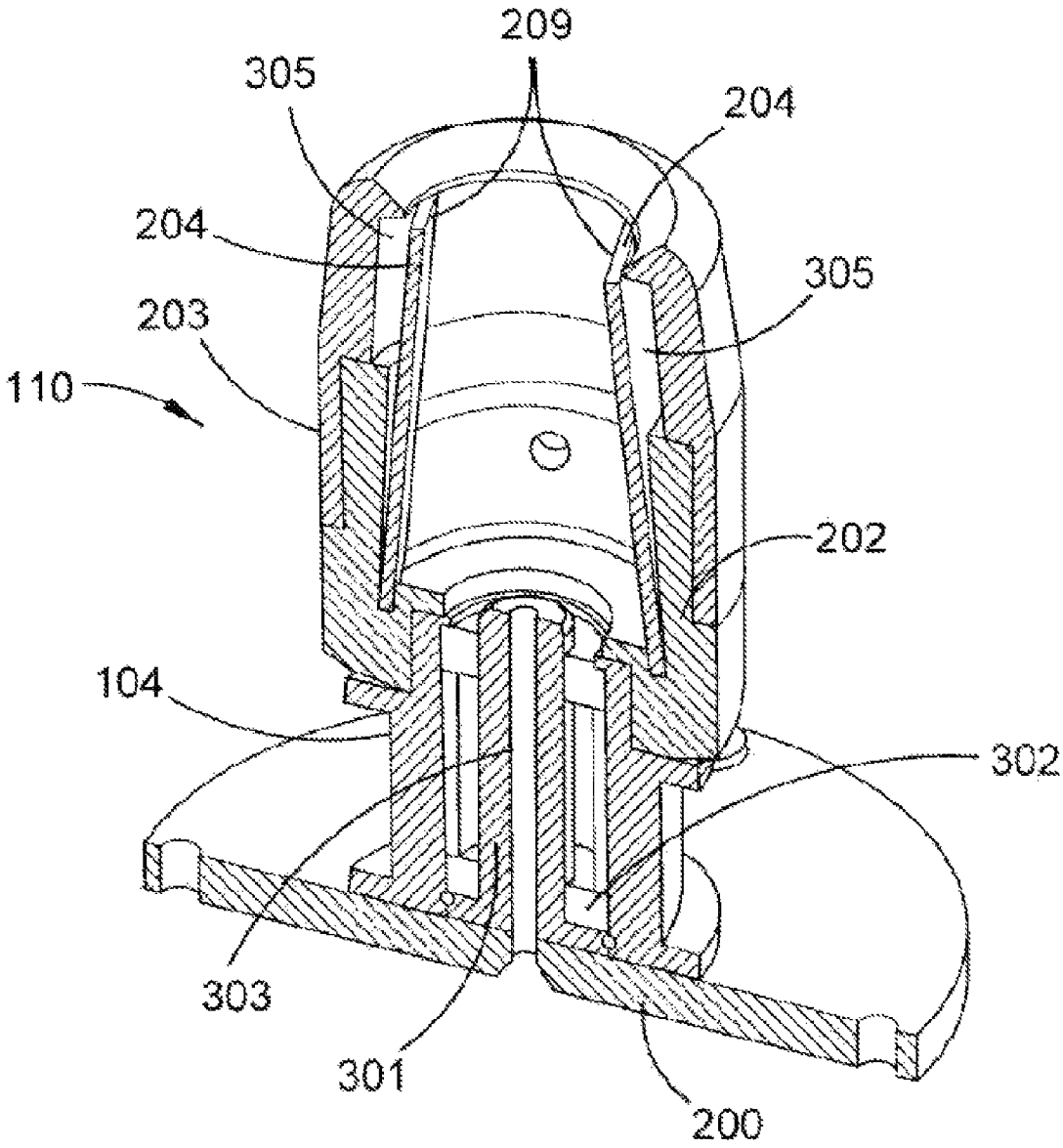
FIG. 3 is a cross-section of the core-spinning head that shows the inner passage for the core yarn, the bearings, and the support structure for the CNT wafers. A removable outer shell allows access to thread-up the webs onto the core, which is then replaced for high-speed operation.

A sectional view of the core-spinning head 110 is shown in FIG. 3, in which the base 200 is shown with a stem 301 supporting two bearings 302. A duct 303 is bored along the axis of the stem to provide a path for the input yarn 101, not shown, through the core-spinning head. The hollow spindle whorl 104 is supported by the bearings 302 and in turn supports the wafer support body 202. Within the wafer support body are located elongate metal plates 305 that extend in an axial direction and provide mounts to which the silicon wafers 204 with their respective nanofibre forests 209 are attached by some convenient method. The inventors have found that double-sided tape works quite well for this. The sides of the wafer support body are cut away to provide access to the nanofibre forests 209 to initiate the draw that creates the nanofibre ribbons that are attached to the core yarn.

The process of core-spinning nanofibres around a continuous core yarn can be done at much higher speeds than nanofibres can be spun into a yarn without a core. One advantage of core-spinning is that a core yarn provides higher strength that provides in turn for easier manipulation of the yarn during processing, improving efficiencies. Another advantage is that the quality of the nanofibre forest as measured by drawability can be relaxed somewhat due to the capacity of the core yarn to support local breakdowns in the web formation. The main advantage, however, is that since the spinning speed [$min^{-1}$] is inversely proportional to the diameter of the yarn, the throughput speed is significantly higher. By way of example only, using a drawing speed of 10 m/min for nanofibre forests as the threadline speed for core-spinning a spindle speed of 5 600 $min^{-1}$ produces a helix angle of about 10°; a spindle speed of 18 400 $min^{-1}$ gives a helix angle of 30°; and a spindle speed of 37 900 $min^{-1}$ gives a helix angle of 50°. It will be understood to those familiar with the art that many other combinations of helix angle, spindle speed, and threadline speed are possible and are consistent with the invention.

Figure 4:
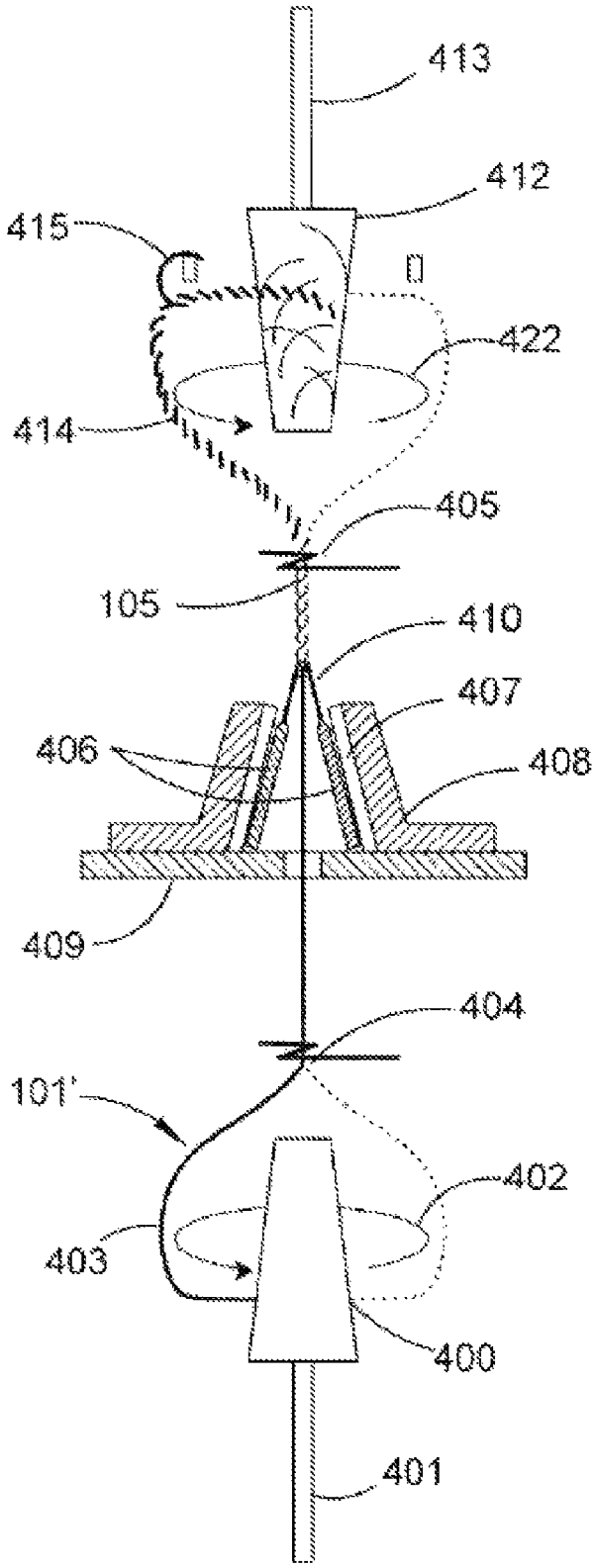
FIG. 4 is a schematic showing an alternative method for core spinning nanofibre webs around cores of selected materials and constructions that is based on rotating the yarn while keeping the nanofibre forests stationary.

Another possible version of core-spinner is shown in FIG. 4. The alternative principle used for this embodiment of the invention is to keep the wafers stationary, i.e. they do not rotate around the yarn as it passes through the core-spinning head. In this embodiment, the core-yarn simultaneously rotates and traverses between two forests that have been grown on silicon wafers, and in so doing, the nanofibre webs are spun helically around the core yarn. As high twists are sometimes used to spin the nanofibre webs, an optional feature is to spin the supply package at the rotational speed of the take-up package, which cancels any twist that might be formed in the core yarn. Eliminating twist from the core yarn is particularly desirable if metal wires are used as core yarns. This is an optional feature because for some engineered yarns, the creation of some twist in the core is desirable.

In the core-spinner illustrated in FIG. 4, a supply package 400 for a core yarn or filament 101' is supported and driven by spindle 401, drives and bearings not shown, in the optional direction 402 to form a take-off balloon 403 in the travelling core filament or yarn 101'. The top of the balloon is controlled by a thread guide 404 and the output path of the core-spun yarn 105' is controlled by thread guide 405. The controlled path of the core yarn 101' is arranged to pass close to nanofibre forests 406 grown on silicon wafers 407 that are supported by supports 408 that in turn are supported by a platform 409. As the spinning core yarn 101' traverses between the nanofibre forests, nanofibre ribbons 410 are drawn laterally from the forests 406 and assemble helically on the core yarn 101' to form nanofibre core-yarn 105'. The core-spun yarn is then wound onto a take-up bobbin 412 that is supported and driven by spindle 413. As the assembly is wound onto the package in the direction 422 a take-up balloon 414 is created, which is controlled optionally by ring and traveller 415, or by an optional driven traveller, the drives of which are not shown.

FIG. 5 is a SE micrograph of a multi-filament nylon (polyamide) yarn suitable for use as a core 101, while FIGS. 6 and 7 show, with different magnifications, a core-spun nanofibre yarn produced with the apparatus of FIGS. 1 to 3. The yarn comprises a CNT nanofibre ribbon core-spun around a nylon multi-filament core at an angle of twist of about 40°. The fibrillar structure is especially visible in FIG. 7.

The package of core yarn can be prepared by any of the standard technologies commonly used in textile processing, such as winders and twisters. For metal wires of various elements and constructions, such as aluminium or copper braids, the supply package may be a cylindrical coil. In this case the package is arranged to rotate on an axis rather than pull off over the end, which avoids adding twist.

A significant advantage of the invention is the capability to combine the nanotubes with other textile fibres, yarns, slivers, braids and knits to make composite textile structures with a unique combination of properties.

Core-spun yarns according to the invention can be knitted into textile structures as normal, and may have an electrical resistance many orders of magnitude lower than for conducting polymers.

Nanofibre webs can be core-spun with flexible wire braids. In this case care may be required to ensure that the wires are not subject to excessive strain during processing. If desired, the wires can be covered with an insulating layer in which case the resulting yarn has the properties of a coaxial cable but is sufficiently fine to be knitted or woven into fabrics.

A benefit of core-spinning CNTs with carbon fibre is the increase breaking strain and toughness because high modulus carbon fibre is relatively brittle. The helix angle can be adjusted to provide a desired breaking strain, the greater the helix angle the greater the breaking strain. Given that breaking strains of carbon fibre are usually less than 1%, and often less than 0.3%, the significant benefit of core-spun carbon fibre yarns is the much higher breaking strains, typically greater than 4% and may be greater than 8%.

The invention claimed is:

1. A nanofibre yarn assembly including a longitudinally extending core for the yarn assembly and, twisted about the core, at least one ribbon of multiple carbon nanotubes.

2. A nanofibre yarn assembly according to claim 1 wherein there are a plurality of ribbons of multiple carbon nanotubes, the respective ribbons forming successive layers twisted about the core.

3. A nanofibre yarn assembly according to claim 2 wherein different ribbons are twisted in opposite directions about the core.

4. A nanofibre yarn assembly according to claim 1 wherein the core does not contain nanofibres.

5. A nanofibre yarn assembly according to claim 1 wherein the core includes or consists of nanofibres.

6. A nanofibre yarn assembly according to claim 1 wherein the core comprises a textile fibre assembly and/or one or more filaments.

7. A nanofibre yarn assembly according to claim 6 wherein the core is a yarn.

8. A nanofibre yarn assembly according to claim 6 wherein the core is a multi filament structure.

9. A nanofibre yarn assembly according to claim 6 wherein the core is a braided structure.

10. A nanofibre yarn assembly according to claim 1 wherein the core includes one or more wire components.

11. A nanofibre yarn assembly according to claim 1 comprising a core-spun nanofibre yarn.

12. A method of forming a nanofibre yarn assembly, including drawing a longitudinally extending core for the yarn assembly through a concentric core-spinning zone, and, as the core travels through the core-spinning zone, twisting at least one ribbon of multiple carbon nanotubes about the travelling core.

13. A method according to claim 12, including twisting a plurality of ribbons of multiple carbon nanotubes about the travelling core whereby the respective ribbons form successive layers about the core.

14. A method according to claim 13, wherein different ribbon(s) are twisted in opposite directions about the core.

15. A method according to claim 12, including forming said ribbon(s) from carbon nanotubes drawn from one or more nanotube forests supported on a substrate.

16. A method according to claim 15 wherein the carbon nanotubes are drawn laterally to the nanotube orientation in the forest(s), as a continuous assembly of linked nanotubes.

17. A method according to claim 15 wherein the ribbon(s) are twisted about the core by rotating the carbon nanotube forest(s) around the travelling core.

18. A method according to claim 15 wherein the ribbon(s) are twisted about the core by maintaining the forest(s) stationary and rotating the core as it is pulled past the forest(s) so that the nanotube ribbon is twisted about the core.

19. A method according to claim 18 wherein the core is rotated by spinning a take-up or supply package for the core, or both.

20. A method according to claim 12 wherein the core does not contain nanofibres.

21. A method according to claim 12 wherein the core includes or consists of nanofibres.

22. A method according to claim 12 wherein the core comprises a textile fibre assembly and/or one or more filaments.

23. A method according to claim 22 wherein the travelling core is a yarn.

24. A method according to claim 22 wherein the travelling core is a multi filament structure.

25. A method according to claim 22 wherein the travelling core is a braided structure.

26. A method according to claim 12 wherein the core includes one or more wire components.

27. A method according to claim 12 wherein the nanofibre yarn assembly is a core-spun nanofibre yarn.

28. Apparatus for forming a nanofibre yarn assembly, including means to draw a longitudinally extending core for the yarn assembly through a concentric core-spinning zone, support structure to mount a source of nanofibres in or adjacent to the concentric core-spinning zone, and means to twist at least one ribbon of multiple nanofibres drawn from said source about the core, as the core travels through the concentric core-spinning zone;

wherein said support structure is arranged to mount a source of nanofibres comprising one or more carbon nanotube forests.

29. Apparatus according to claim 28 wherein said apparatus is arranged to twist a plurality of ribbons of multiple nanofibres about the travelling core whereby the respective ribbons form successive layers about the core.

30. Apparatus according to claim 29 wherein said twisting means is operable to twist different ribbons in opposite directions about the core.

31. Apparatus according to claim 28, wherein said support structure is a generally cylindrical body with internal mounts for the one or more carbon nanofibre forests, and the twisting means is a rotatable spindle on which said body is mounted.

32. Apparatus according to claim 28, wherein said twisting means is configured to rotate said support structure and thereby the carbon nanotube forest(s) about the travelling core.

33. Apparatus according to claim 28, wherein said support structure is stationary and the twisting means is configured to rotate the core as it is pulled past the forest(s) so that the nanofibre ribbon(s) are twisted about the travelling core.

34. Apparatus according to claim 33, further including means to mount respective supply and take-up packages for the core, wherein said twisting means is configured to spin the supply and/or take-up packages.

* * * * *